US006782686B2

(12) United States Patent
Mills

(10) Patent No.: US 6,782,686 B2
(45) Date of Patent: Aug. 31, 2004

(54) TWISTING THEN CABLING BCF YARNS TO IMPART TORQUE

(75) Inventor: Maya D. Mills, Dalton, GA (US)

(73) Assignee: Invista North America S.a.r.l., Wilmington, DE (US)

( * ) Notice: Subject to any disclaimer, the term of this patent is extended or adjusted under 35 U.S.C. 154(b) by 162 days.

(21) Appl. No.: 10/106,019

(22) Filed: Mar. 25, 2002

(65) Prior Publication Data

US 2002/0166316 A1 Nov. 14, 2002

Related U.S. Application Data

(60) Provisional application No. 60/280,586, filed on Mar. 30, 2001.

(51) Int. Cl.[7] ..... D02G 3/28

(52) U.S. Cl. ..... 57/237; 57/211; 57/238; 57/239

(58) Field of Search ..... 57/211, 236, 237, 57/238, 239, 244, 246, 314; 428/85, 92, 97

(56) References Cited

U.S. PATENT DOCUMENTS

| | | | | | |
|---|---|---|---|---|---|
| 421,158 | A | * | 2/1890 | Briggs | 57/237 |
| 1,689,119 | A | * | 10/1928 | Evans | 139/426 R |
| 2,253,048 | A | * | 8/1941 | Quindry | 87/8 |
| 3,583,346 | A | * | 6/1971 | Bloch et al. | 112/410 |
| 3,690,056 | A | * | 9/1972 | Peters | 57/237 |
| 3,831,368 | A | * | 8/1974 | Glowacki | 57/239 |
| 3,950,932 | A | | 4/1976 | Durling | |
| 4,206,589 | A | | 6/1980 | Markey et al. | |

* cited by examiner

*Primary Examiner*—John J. Calvert
*Assistant Examiner*—Shaun R Hurley
(74) *Attorney, Agent, or Firm*—George M. Medwick

(57) ABSTRACT

A method for forming a highly textured loop pile rug and/or carpet using the torque created by twisting then cabling bulk continuous yarns. A flooring article having a textured effect by creating torque in the yarn through the twisting and cabling of bulk continuous fiber.

24 Claims, 3 Drawing Sheets

TWISTING THEN CABLING BCF YARNS TO IMPART TORQUE

CROSS REFERENCE TO RELATED APPLICATION

This application claims the benefit of priority to Provisional Application 60/280,586 filed on Mar. 30, 2001.

FIELD OF THE INVENTION

The invention relates to twisting bulk continuous fiber or synthetic yarn to create torque in the yarn to give a highly textured effect to rugs and carpets created from the yarn.

BACKGROUND OF THE INVENTION

The following disclosures may be relevant to various aspects of the present invention and may be briefly summarized as follows:

U.S. Pat. No. 3,950,932 to Durling discloses a multicolored, cabled, stuffer box crimped yarn containing filaments of respectively at least two non-contrasting colors and a contrasting color, the filaments of the at least two non-contrasting colors imparting a heather appearance to the yarn and the filaments of the contrasting color imparting color accents to the yarn, is produced by cabling together at least three stuffer box crimped multifilament ends, each of the three ends containing filaments of at least two non-contrasting colors and one of the three ends containing filaments of the contrasting color in a discrete grouping and in a proportion greater than the proportion in the same end of filaments of any individual non-contrasting color and, prior to being twisted together with the other ends, containing a twist in the same sense as the twist to be imparted in the step of twisting together all the ends and, after being twisted together with the other ends, preferably containing a twist of a higher degree than the twist contained in the other ends.

U.S. Pat. No. 4,206,589 to Markey et al. discloses a method of forming a self-twisted fibrous structure comprises twisting two strand of similar count such that each has repeated along its length alternating zones of opposite twist, converging the strands at a convergence point such that they partly untwist around one another to form a self-twisted structure and acting on the strands at or downstream of the convergence point by applying further alternating zones of opposite twist so as to modify the strand to ply twist ratio of the structure. The further twist is applied at a point not greater than one-half cycle length from the first twist point and at a phase difference 20° to 60° following.

Presently cotton flooring articles are commonly used for flooring articles such as bath carpets and rugs and other residential uses. Flooring articles made from cotton have a tendency to mat, are not readily dyeable to a desired shade, particularly for dark colors, difficult to clean and have a tendency to develop pills or fuzziness from use. These problems are further accented for textured flooring articles.

It is desirable to have a carpet or flooring article that has a textured design without the above indicated problems. It is also desirable to have a flooring article that requires no heat setting to maintain the textured design of the flooring article. It is further desirable to have a textured loop styling of synthetic yarns for bath and residential end uses.

SUMMARY OF THE INVENTION

Briefly stated, and in accordance with one aspect of the present invention, there is provided a method for forming a textured loop style flooring article comprising: twisting a first yarn end with a second yarn end using a first twist forming a third yarn end; cabling two third yarn ends in a same direction as the first twist of the first yarn end and the second yarn end using a cable twist forming a final yarn, wherein a differential twist occurs between the first twist and the cable twist imparting a torque to the final yarn creating a textured effect in the final yarn; and tufting the final yarn in a loop pile construction of a flooring article having the textured effect.

Pursuant to another aspect of the present invention, there is provided a method for forming a textured loop style flooring article comprising: twisting at least one feed yarn end with a second feed yarn end using a first twist forming a third yarn end; twisting a fourth feed yarn end with a fifth feed yarn end using the first twist forming a sixth yarn end; cabling the third yarn end and the sixth yarn end together in a same direction as the twisting of the yarn ends in forming the third yarn end and the sixth yarn end using a cable twist forming a final yarn, wherein a differential twist occurs between the first twist and the cable twist imparting a torque to the final yarn creating a textured effect in the final yarn; and tufting the final yarn in a loop pile construction of a flooring article having the textured effect.

Pursuant to another aspect of the present invention, there is provided a flooring article having a textured effect comprising: at least two first yarn ends twisted together with a first twist forming a third yarn end, said third yard end and another at least two-ply yarn end twisted together with a cable twist in the same direction as the first twist creating a final yarn; a differential twist occurring between the first twist and the cable twist imparts a torque to said final yarn for a textured effect; and said final yarn being tufted into a loop pile construction.

BRIEF DESCRIPTION OF THE DRAWINGS

The invention will be more fully understood from the following detailed description, taken in connection with the accompanying drawing, in which.

DETAILED DESCRIPTION OF THE INVENTION

Definitions

Figure 1:
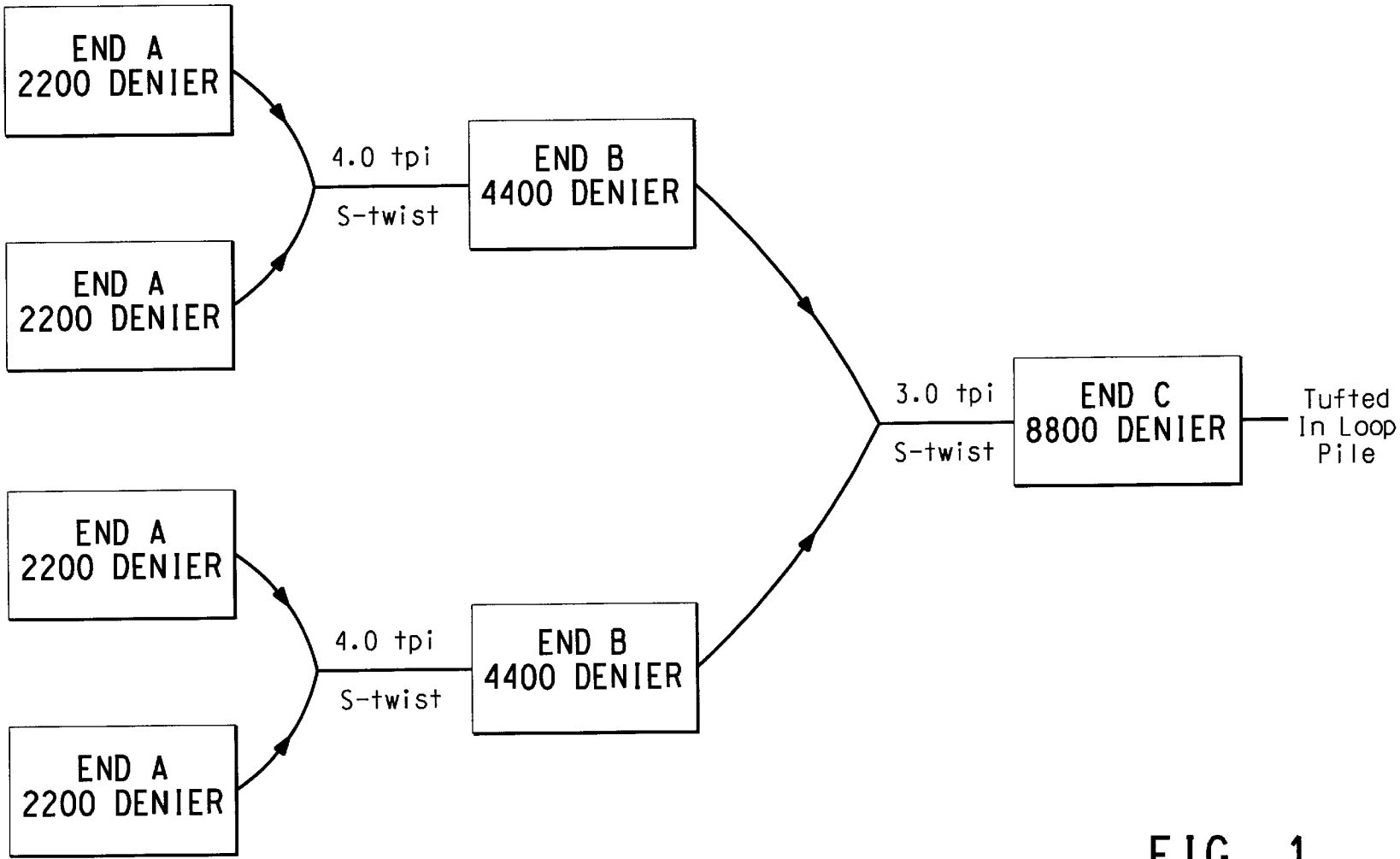
FIG. 1 is a schematic illustration of the process described in Example 1.

The following definitions are provided as reference for interpretation of these terms used in the context of this specification and the accompanying claims.

1. Cable: to twist together two or more folded yarns.
2. Cabled yarn: is two or more folded yarns twisted together in one or more operations. Combinations of single yarn(s) may be described as cabled yarns, e.g. a single yarn twisted together with two folded yarns to build yarn size and impart texture to the resulting yarn.
3. Conventional Twister: A system of producing a folded yarn by twisting together two or more single yarns simultaneously.
4. Dpf: denier per filament.
5. End: An individual strand or filament for twisting.
6. Folded yarn or Plied yarn: A yarn in which two or more single yarns are twisted together in one operation, e.g., two-folded yarn, three-fold yarn, etc. (In some sections of the textile industry these yarns are sometimes referred to as two-ply three-ply, etc.)

7. Loop pile: The pile of a carpet consisting of loops. (e.g. uncut pile)
8. Pile: a surface effect on a fabric formed by tufts or loops of yarn that stand up from the body of the fabric. In carpet, pile is the part of the carpet consisting of textile yarns or fibers, cut or looped, projecting from the substrate and acting as the use-surface.
9. Textured pile: A pile in which the surface character is varied e.g., by having areas of different characteristics or by combinations of different yarn or pile types, (e.g., soft and hard twist.)
10. Tpi: turns per inch (e.g. tpi defines a degree of twist which is the number of turns or twist per unit length)
10: Twist direction: is described as "s" or "z" according to which of these letters has its center inclined in the same direction as the surface elements of a given twisted yarn, when the yarn is viewed vertically (e.g. twisting in the s-direction is clockwise and the z-direction is counter-clockwise)

In the present invention, BCF (bulk continuous fiber) or synthetic yarn such as nylon or other polyamides are used to create a textured loop pile construction for rugs/carpets. Unlike cotton, which has a tendency to mat and pill, is difficult to clean, and is difficult to dye dark colors, synthetic fiber such as nylon 6, 6 is durable, has easy care, colorfast, quick drying and resistant to fuzzing/pilling. Using a conventional twister (such as Volkman, Verdol, ICBT & Hammel), the feed fiber or yarn is plied or twisted with another (i.e. a second) fiber or yarn of the same or different deniers forming a third yarn. This initial twisting (i.e. or first twist) of the yarn to form a third yarn as indicated above is preferably about 1.0 to about 10.0 twists per inch. The feed yarn is preferably at least two-ply and, most preferably two-plied or three-plied. The feed yarns can be colored or white dyeable.

Then, at least two of the plied or twisted third yarns are then cabled together forming a final yarn. The third yarns cabled together can be either of the same denier, or of different deniers. (For example, a first third yarn can be comprised of two 2250 denier/11.5 dpf and a second third yarn can be comprised of two 1400 denier/10 dpf. Then the first third yarn and second third yarn of different deniers can be cable twisted forming a final yarn. The dpf effects the hand or softness of the finished yarn.) The total denier of the final yarn preferably ranges from about 2,000 to about 20,000. The yarns that are cabled together preferably have a cable twist of about 0.5 to about 10 twists per inch.

In the present invention, a twist differential must occur between the initial twisting of the feed yarn and the cable twisting to provide a torque to the final yarn for the textured look desired. The torque causing the textured effect is a novel element of the present invention. The twist differential is a delta between the degree of twist at the initial twist and the cable twist. (For example, if the initial twist is 3.0 tpi and the cable twist is 2.0 then the twist differential is (3.0 tpi −2.0 tpi) =1.0 tpi.). Furthermore, the twisting and the cable twisting must be twisted in the same direction (e.g. s-direction or the z-direction). That is, if the initial twist is in the s-direction then the cable twist for the final yarn must be in the s-direction not the z-direction. Similarly if the initial twist is in the z-direction then the cable twist for the final yarn must also be in the z-direction. In order to maximize the torque/textured effect, the yarn should not be heatset.

There can be additional twisting of the yarns with the same or different deniers after the initial twisting and prior to cabling into the final yarn.

Referring now to the drawings, where the showing is for the purpose of describing an embodiment of the invention and not for limiting same. The twisting operations may be conducted on any conventional twisters such as Volkman, Verdol, ICBT & Hammel. The examples below were twisted using a Volkman twister.

Figure 2:
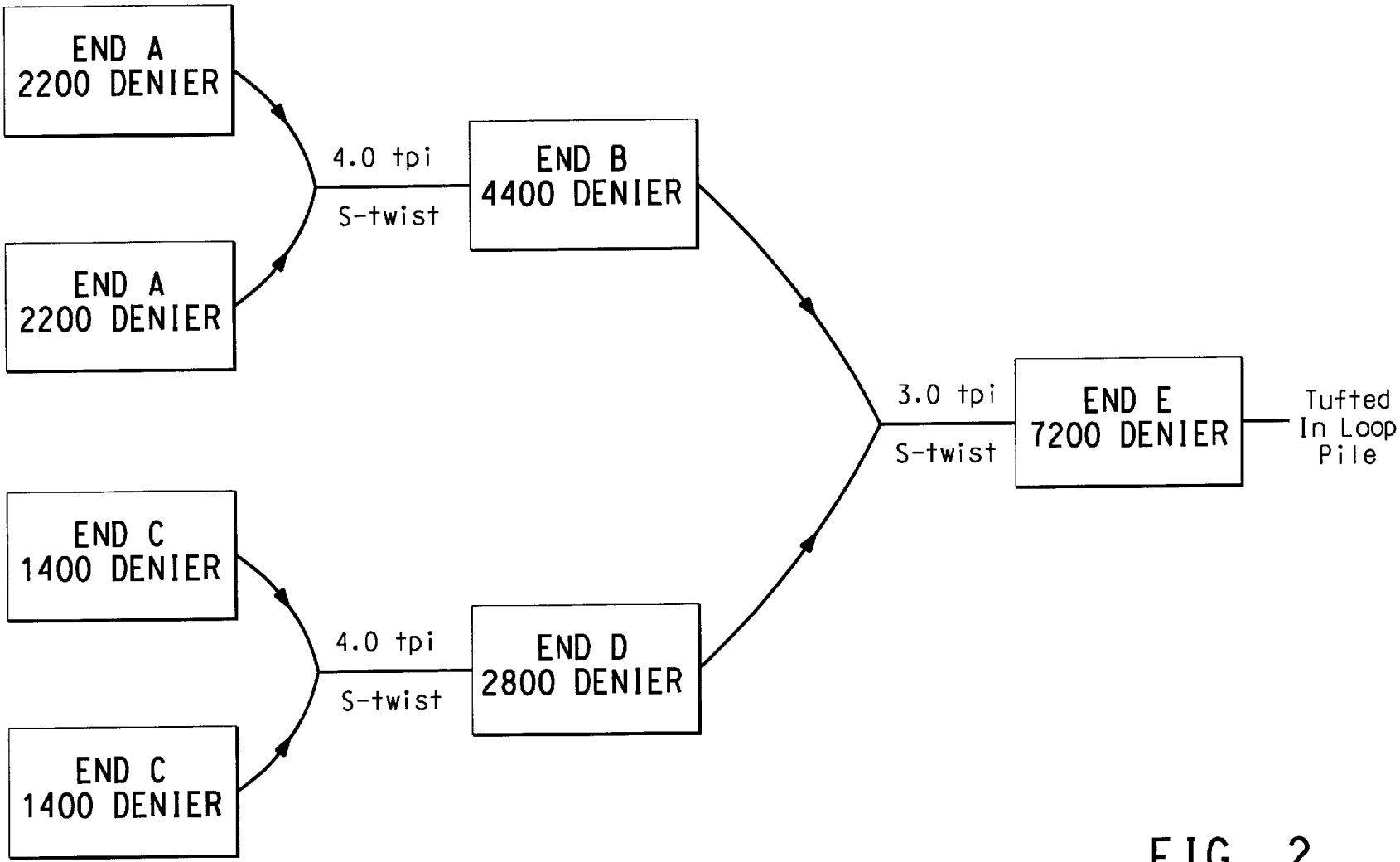
FIG. 2 is a schematic illustration of the process described in Example 2.

Examples of the present invention are illustrated in FIGS. 1 and 2 and will be briefly described below. The feed yarn, end-A in FIG. 1, is the starting point. A variety of samples of different denier were made using the following yarns as end-A:

1400-denier/10-dpf 2250-denier/11.5 dpf

995×2/12.5 dpf 1800-denier/8-dpf

The same process as described in Example 1 below was used for each of these samples which also yielded the textured loop pile of the present invention.

EXAMPLES

Example 1

One end of 2200-denier/8-dpf (end-A in FIG. 1) was plied with another end of 2200-denier/-8-dpf (end-A in FIG. 1) at 4.0 twist per inch in "s" direction to form a 4400-denier (end-B in FIG. 1) Then, two ends of 4400-denier (end-B in FIG. 1) are cabled together at 3.0 twists per inch in the "s" direction to form a 8800-denier (end-C in FIG. 1) The differential twist (i.e. 4.0 twist per inch -3.0 twist per inch =1.0 twist per inch) of 1.0 twist per inch is imparted as torque to the final yarn. End-C in FIG. 1, was tufted into a rug or carpet in a loop pile construction on a backing using a conventional tufting machine to achieve a textured loop aesthetics. The yarn was not heatset in order to maximize the torque/textured effect.

Example 2

One end of 2200-denier/8-dpf (end-A in FIG. 2) was plied with another end of 2200-denier/-8-dpf (end-A in FIG. 2) at 4.0 twists per inch in "s" direction to form a 4400-denier (end-B in FIG. 2). One end of 1400-denier/10-dpf (end-C in FIG. 2) was plied with another end of 1400-denier/10-dpf (end-C in FIG. 2) at 4.0 twists per inch in the "s" direction to form a 2800-denier yarn (end-D in FIG. 2). Then one end-B was cabled with one end-D at 3.0 twist per inch in "s" direction to form a 7200-denier (end-E in FIG. 2). The differential twist of 1.0 twist per inch imparted the torque to the final yarn. Then the end-E, shown in FIG. 2, was tufted into a rug or carpet in a loop pile construction on a backing on a conventional tufting machine to give a textured loop aesthetics. To maximize the torque/textured effect, the yarn was not heatset.

Figure 3:
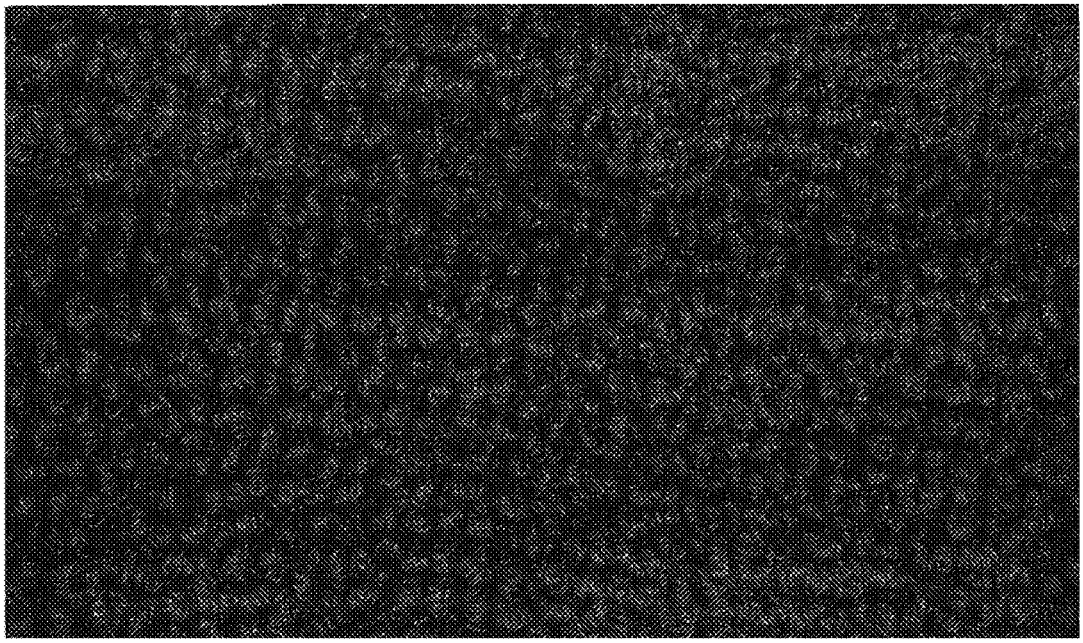
FIG. 3 is a photographic illustration of a textured effect.

Reference is now made to FIG. 3, which shows the textured effect of the yarn in a loop pile construction. The yarn, as shown, has been twisted and cabled to impart the torque to the BCF or synthetic yarn and tufted.

It is therefore, apparent that there has been provided in accordance with the present invention, twisting then cabling BCF yarns to impart torque for a textured loop pile construction that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for forming a textured loop style flooring article comprising:

twisting a first yarn end with a second yarn end using a first twist forming a third yarn end;

cabling two third yarn ends in a same direction as the first twist of the first yarn end and the second yarn end using a cable twist forming a final yarn, wherein a differential twist occurs between the first twist and the cable twist imparting a torque to the final yarn creating a textured effect in the final yarn, wherein the final yarn comprises a denier of about 2000 to about 20,000; and tufting the final yarn in a loop pile construction of a flooring article having the textured effect.

2. The method of claim 1, wherein the third yarn comprises a two-plied yarn and a three-plied yarn.

3. The method of claim 1 or 2, wherein the first twist ranges from about 1.0 twists per inch to about 10.0 twists per inch.

4. The method of claim 3, wherein the cable twist ranges from about 0.5 twists per inch to about 10 twists per inch.

5. The method of claim 1 or 4, wherein the differential twist ranges from about 0.5 twists per inch to about 9.5 twists per inch.

6. The method of claim 1, wherein the same direction of the twist for the twisting step and the cabling step is in an s-direction.

7. The method of claim 1, wherein the same direction of the twist for the twisting step and the cabling step is in a z-direction.

8. The method of claim 1, wherein the final yarn comprises a non heatset synthetic yarn.

9. A method for forming a textured loop style flooring article comprising:

twisting at least one feed yarn end with a second feed yarn end using a first twist forming a third yarn end;

twisting a fourth feed yarn end with a fifth feed yarn end using the first twist forming a sixth yarn end;

cabling the third yarn end and the sixth yarn end together in a same direction as the twisting of the yarn ends in forming the third yarn end and the sixth yarn end using a cable twist forming a final yarn, wherein a differential twist occurs between the first twist and the cable twist imparting a torque to the final yarn creating a textured effect in the final yarn, wherein the final yarn comprises a denier of about 2,000 to about 20,000; and tufting the final yarn in a loop pile construction of a flooring article having the textured effect.

10. The method of claim 9, wherein the third yarn comprises a two-plied yarn and a three-plied yarn.

11. The method of claim 10, wherein the cable twist ranges from about 0.5 twists per inch to about 10 twists per inch.

12. The flooring article of claim 9 or 11, wherein the differential twist ranges from about 0.5 twists per inch to about 9.5 twists per inch.

13. The method of claim 9 or 11, wherein the first twist ranges from about 1.0 twists per inch to about 10.0 twists per inch.

14. The method of claim 9, wherein the same direction of the twist for the twisting step and the cabling step is in an s-direction.

15. The method of claim 9, wherein the same direction of the twist for the twisting step and the cabling step is in a z-direction.

16. The method of claim 9, wherein the final yarn comprises a non heatset synthetic yarn.

17. A flooring article having a textured effect comprising at least two first yarn ends twisted together with a first twist forming a third yarn end, said third yard end and another at least two-ply yarn end twisted together with a cable twist in the same direction as the first twist creating a final yarn; a differential twist occurring between the first twist and the cable twist imparts a torque to said final yarn for a textured effect; and said final yarn being tufted into a loop pile construction, wherein the final yarn comprises a denier of about 2,000 to about 20,000.

18. A flooring article of claim 17, wherein the another at least two-ply yarn end comprises a same or different denier than said third yard end.

19. The flooring article of claim 1 or 18, wherein the first twist comprises about 1.0 twists per inch to about 10 twists per inch.

20. The flooring article of claim 19, wherein the cable twist ranges from about 0.5 twists per inch to about 10 twists per inch.

21. The flooring article of claim 17 or 20, wherein the differential twist ranges from about 0.5 twists per inch to about 9.5 twists per inch.

22. The flooring article of claim 17, wherein the first twist and cable twist are in an s-direction.

23. The flooring article of claim 17, wherein the first twist and the cable twist are in a z-direction.

24. The flooring article of claim 17, wherein the final yarn comprises a non heatset synthetic yarn.

* * * * *